US007677923B1

(12) United States Patent
Chen et al.

(10) Patent No.: US 7,677,923 B1
(45) Date of Patent: Mar. 16, 2010

(54) DOUBLE VISUAL-INTERFACE SOCKET

(75) Inventors: Mark Chen, Taipei (TW); Ching-Tung Lu, Banqiao (TW)

(73) Assignees: Compupack Technology Co., Ltd., Taipei (TW); Fen Ying Enterprises Co., Ltd., Taipei County (TW)

( * ) Notice: Subject to any disclaimer, the term of this patent is extended or adjusted under 35 U.S.C. 154(b) by 0 days.

(21) Appl. No.: 12/499,975

(22) Filed: Jul. 9, 2009

(51) Int. Cl.
*H01R 13/60* (2006.01)

(52) U.S. Cl. ..... 439/541.5

(58) Field of Classification Search ..... 439/541.5, 439/79, 80

See application file for complete search history.

(56) References Cited

U.S. PATENT DOCUMENTS 6,910,917 B2 * 6/2005 Chen ..... 439/541.5

2007/0232131 A1 * 10/2007 Ju ..... 439/541.5

* cited by examiner

*Primary Examiner*—Phuong K Dinh
(74) *Attorney, Agent, or Firm*—Roger H. Chu

(57) ABSTRACT

A double visual-interface socket compliant with socket design rules set forth in the Digital Visual Interface standard comprises: a lower socket unit including plural L-shaped terminal pins; an upper socket unit disposed above the lower socket unit and including plural terminal pins; an adapter module including plural L-shaped pins arranged in rows; and a circuit board having plural terminal guide holes and plural extension guide holes. The terminal guide holes are inserted by, soldered to, and therefore electrically connected with the terminal pins of the upper socket unit, respectively. The extension guide holes are electrically connected with the terminal guide holes, respectively, and are inserted by, soldered to, and therefore electrically connected with ends of the L-shaped pins of the adapter module, respectively. The opposite ends of the L-shaped pins of the adapter module are substantially aligned with bottom ends of the L-shaped terminal pins of the lower socket unit.

11 Claims, 12 Drawing Sheets

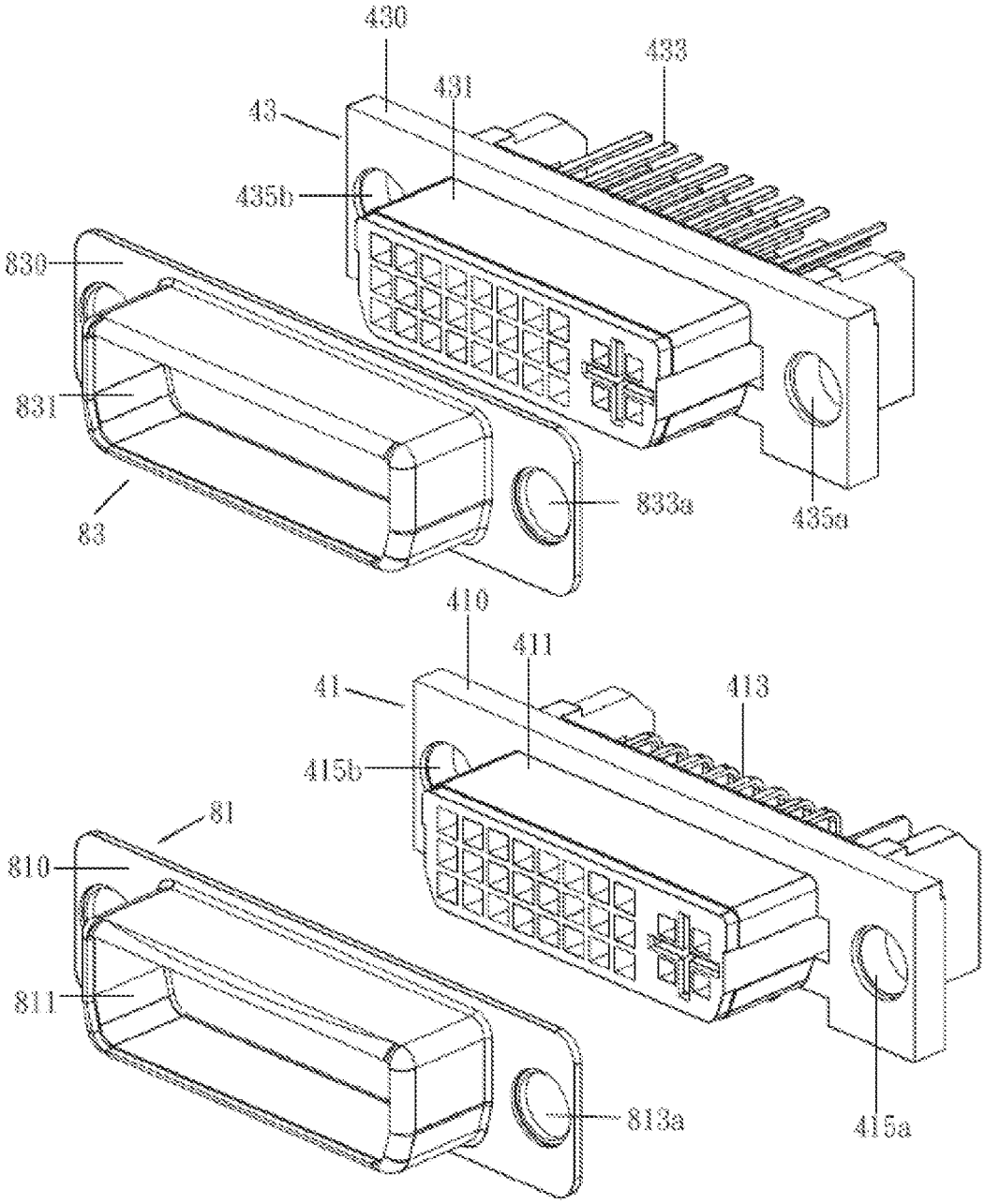
FIG. 2.1

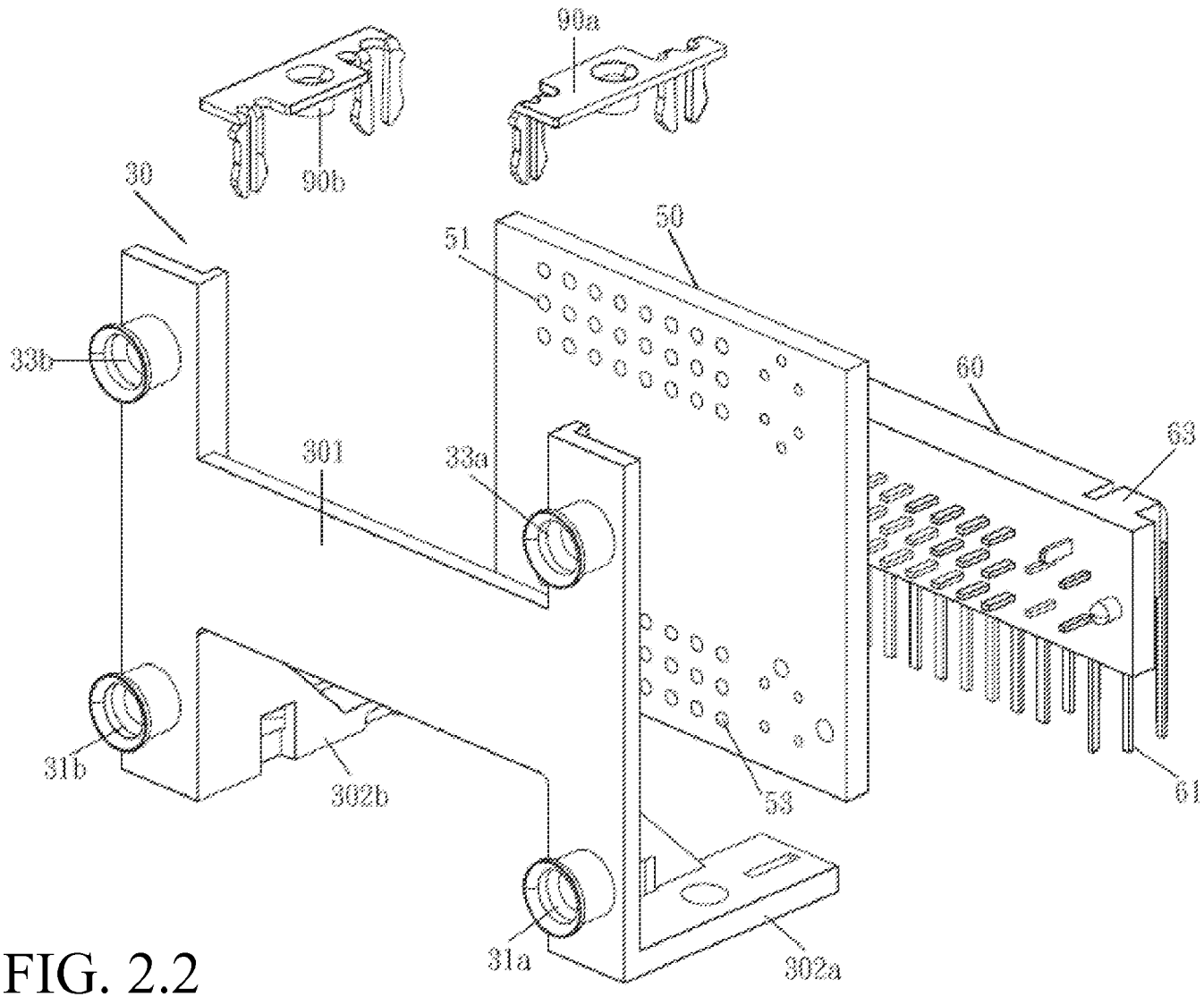
FIG. 2.2

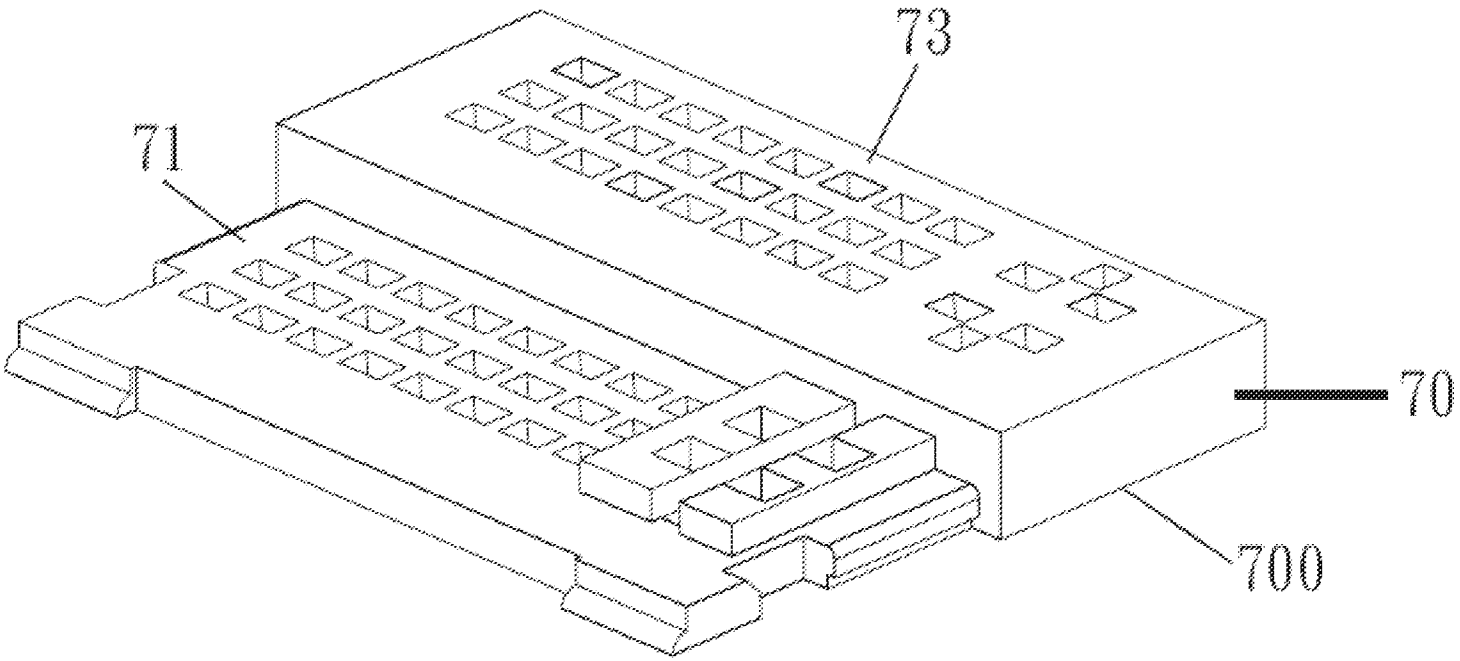
FIG. 2.3

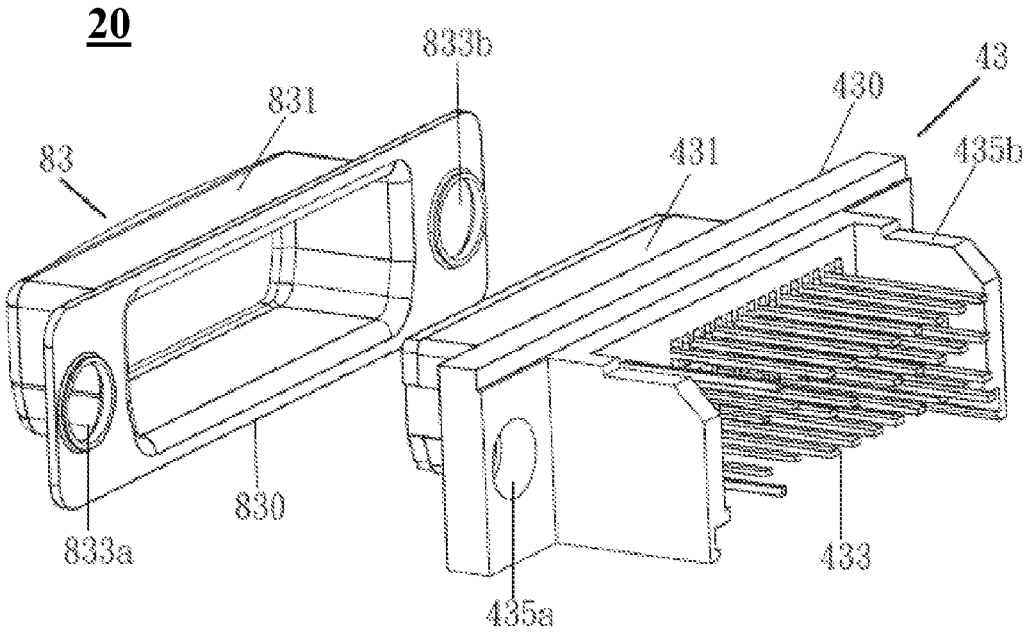
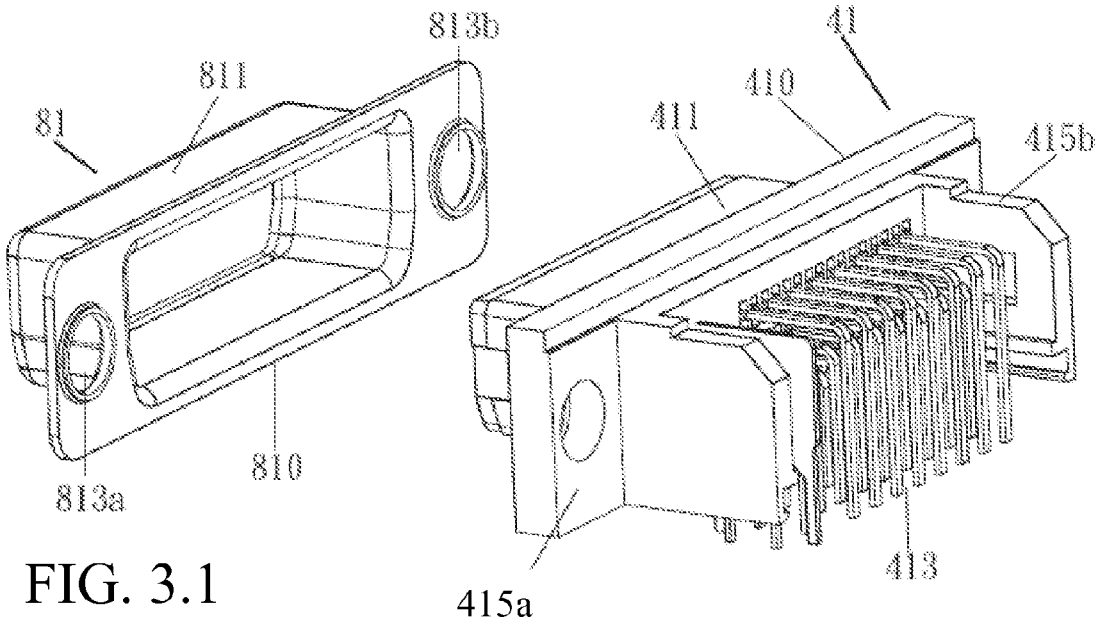
FIG. 3.1

20
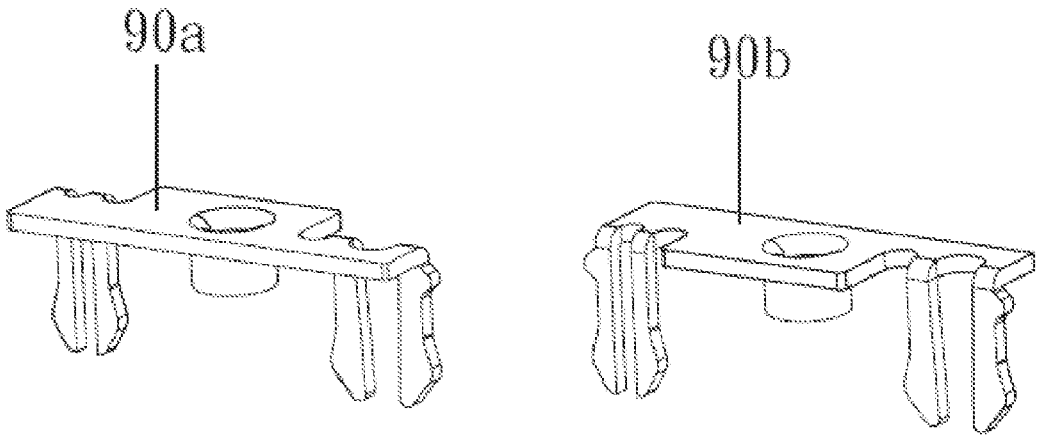
FIG. 3.2

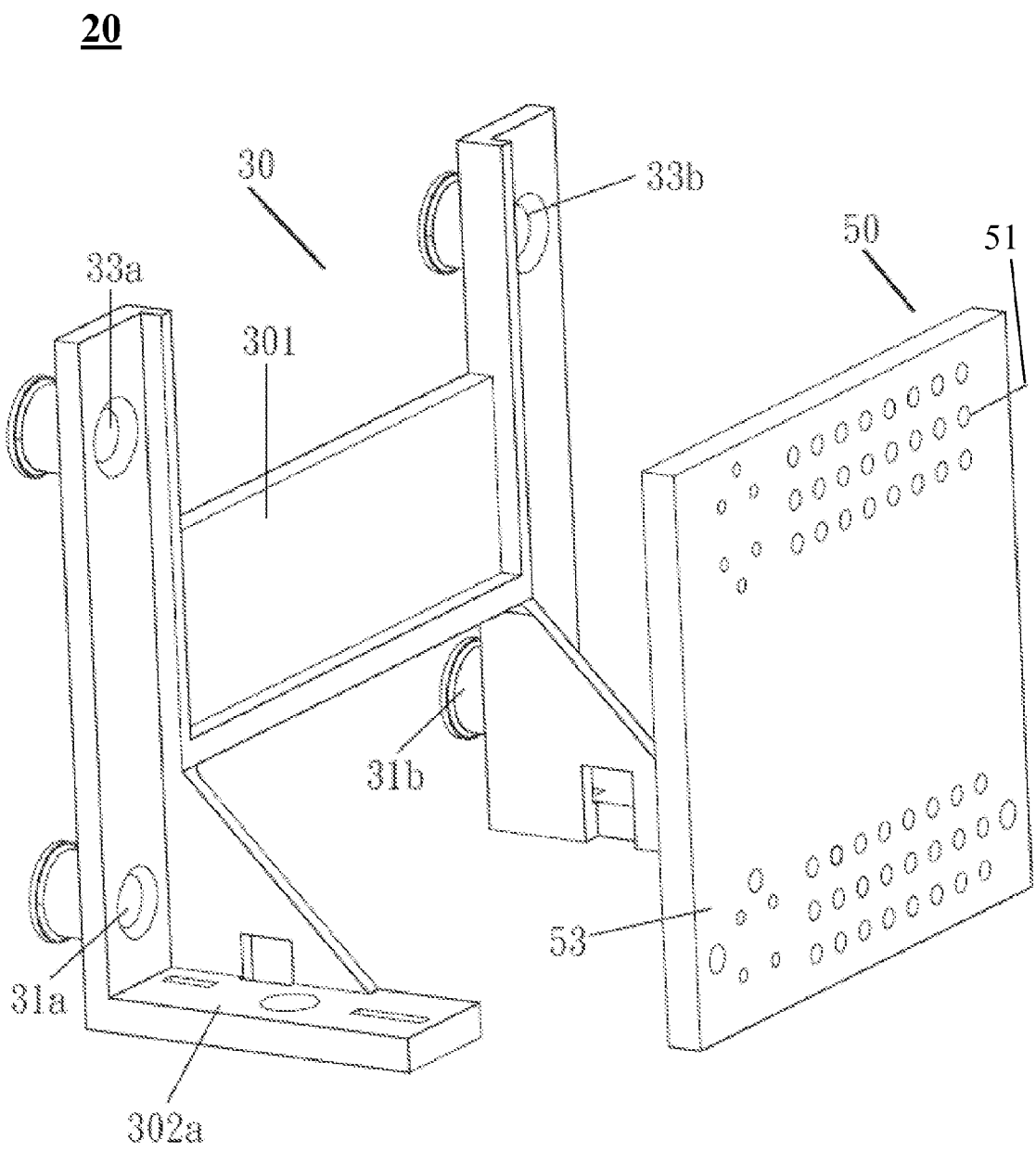
FIG. 3.3

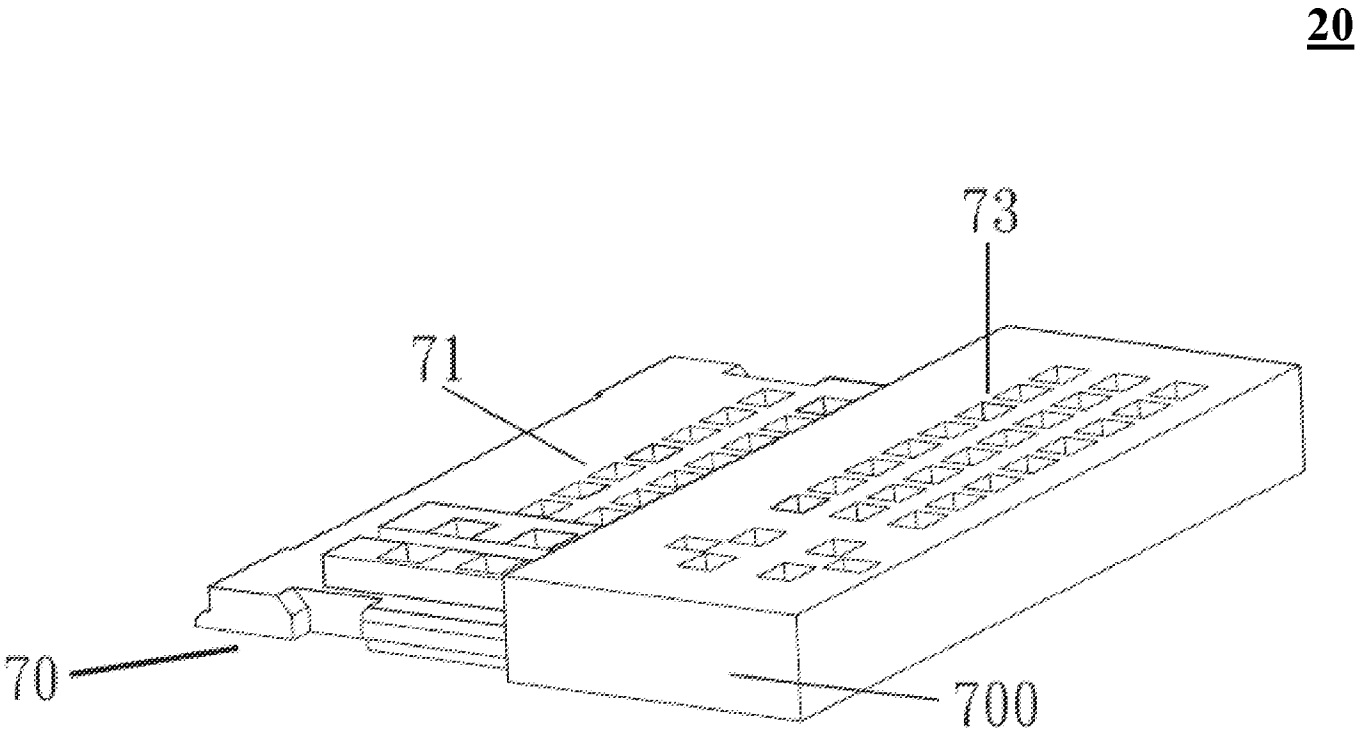
FIG. 3.4

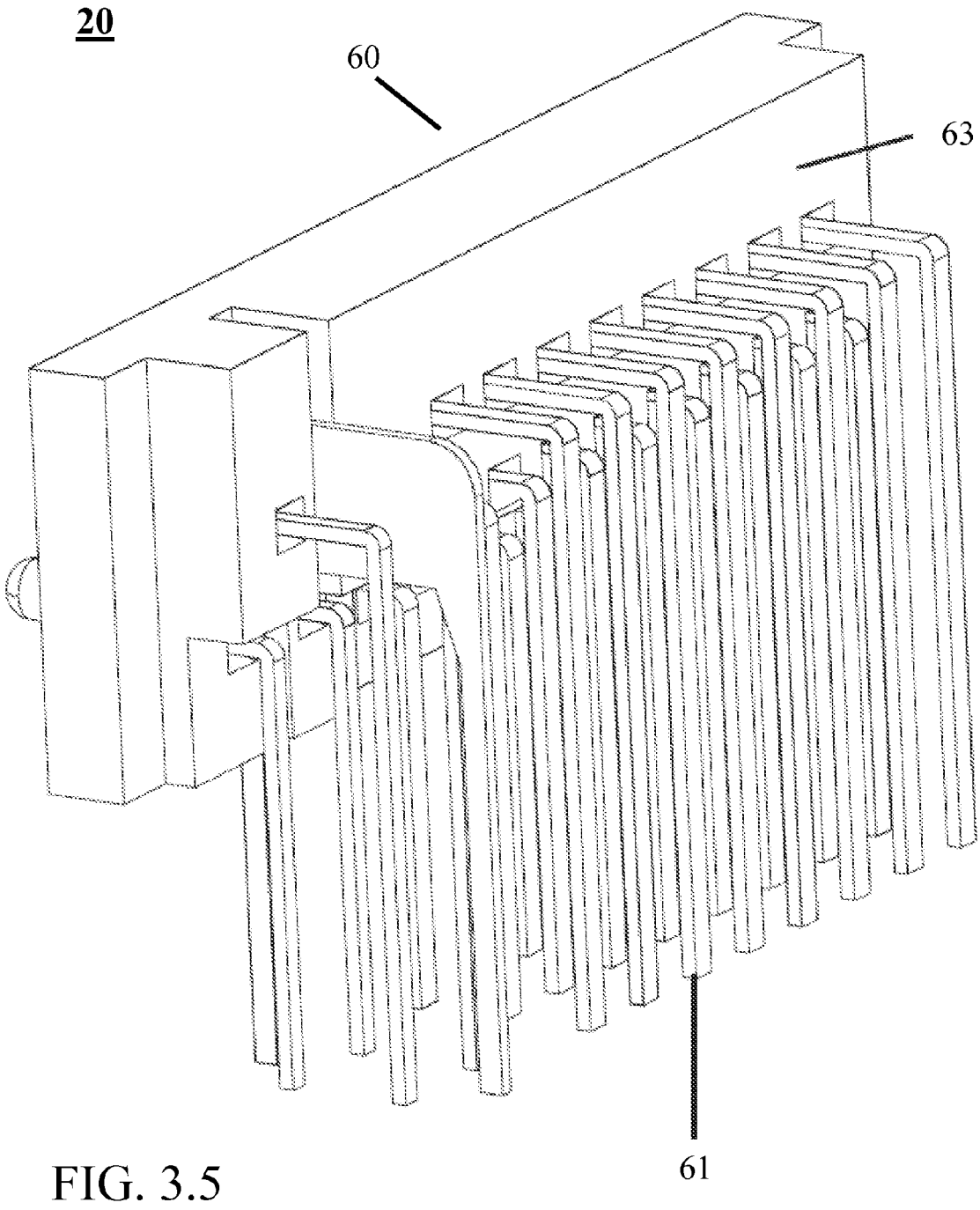
FIG. 3.5

DOUBLE VISUAL-INTERFACE SOCKET

BACKGROUND OF THE INVENTION

1. Technical Field

The present invention relates to an electronic connector and, more particularly, to a double visual-interface socket compliant with the Digital Visual Interface (DVI) standard.

2. Description of Related Art

With the advancement of technology, computer peripherals have become so diversified that the number of sockets provided in a computer must increase accordingly. In consequence, the so-called composite or stacked-type sockets were developed, wherein a plurality of sockets are stacked together three-dimensionally and integrated into a single socket, thereby not only reducing the footprint of the otherwise multiple sockets on a motherboard or interface card, but also simplifying the pin insertion procedure.

Please refer to FIG. 1 for a sectional view of a conventional stacked-type socket 10. The stacked-type socket 10 includes a housing 100. Socket units 11, 13, 15 are stacked in the housing 100 and include terminal pins 110, 130, 150, respectively. In order for the terminal pins 110, 130, 150 to pass through a bottom surface of the housing 100 and be subsequently inserted into guide holes of a connection port on a circuit board in a backend application, the terminal pins 130 of the middle socket unit 13 and the terminal pins 150 of the top socket unit 15 must be increased progressively in length, relative to the terminal pins 110 of the bottom socket unit 11.

Digital Visual Interface (DVI), a high-speed series interface standard dedicated to the transmission of digital and analog video signals, is intended to enhance the image quality of computer displays and has been widely used in various display devices such as flat panel displays and digital projectors. The Digital Visual Interface has a clock frequency ranging from 20 MHz to 165 MHz so as to achieve high resolution and meet the requirement of high-capacity, high-frequency transmission for large displays. In addition, the Digital Visual Interface allows a bandwidth up to 1.65 Gbps in a Single Link transmission mode, and over 2 Gbps in a Dual Link transmission mode. Therefore, strict requirements in high-frequency properties are specified in the DVI standard for connection cables and sockets which serve as signal transmission paths. To ensure signal quality, all DVI compatible products on the market must pass related tests and conform to specifications set forth in the DVI standard.

Presently, double visual-interface sockets have been successfully developed for dual-screen computer systems. However, if the aforesaid design of the conventional stacked-type sockets is applied to a double visual-interface socket, the terminal pins of the upper socket unit must be extended so as for bottom ends of these terminal pins, as well as those of the lower socket unit, to reach a solder surface at a bottom portion of the socket; as a result, the characteristic impedance of the resulting double visual-interface socket do not comply with related specifications.

In a high-frequency transmission system, it is a basic design requirement to achieve match of characteristic impedance between components. A mismatch of impedance between components will result in signal reflection, which in turn leads to production of noise and signal interference. As the lengths of terminal pins are a major factor in the characteristic impedance of a double visual-interface socket, it is a challenge faced by all socket designers to overcome the problem of impedance mismatch caused by the conventional stacked-type socket design.

BRIEF SUMMARY OF THE INVENTION

Therefore, it is an objective of the present invention to provide a double visual-interface socket such that signals at terminal pins of an upper socket unit are connected to a solder surface at a bottom portion of the socket by means of a circuit board and an adapter module, thereby bringing the characteristic impedance of the finished product into conformity with related specifications.

To achieve the above and other objectives, the present invention provides a double visual-interface socket compliant with socket design rules set forth in the DVI standard. The double visual-interface socket of the present invention includes a frame, a lower socket unit, an upper socket unit, an adapter module, and a circuit board.

Therein, the frame has a positioning wall and a bottom plate coupled perpendicularly together. The lower socket unit is provided transversely at the positioning wall and includes a plurality of L-shaped terminal pins, wherein the L-shaped terminal pins have bottom ends facing a plane where a bottom surface of the bottom plate is located. The upper socket unit is provided transversely at the positioning wall and above the lower socket unit, and includes a plurality of terminal pins. The adapter module includes a plurality of L-shaped pins arranged in rows, wherein the L-shaped pins correspond in arrangement to the L-shaped terminal pins of the lower socket unit. The circuit board is disposed adjacent to the positioning wall and has a plurality of terminal guide holes and a plurality of extension guide holes. The terminal pins of the upper socket unit are inserted respectively into the terminal guide holes so as to be electrically connected therewith by soldering. Each of the extension guide holes is electrically connected with a corresponding one of the terminal guide holes. The L-shaped pins of the adapter module have ends inserted respectively into the extension guide holes so as to be electrically connected therewith by soldering. The L-shaped pins of the adapter module further have opposite ends substantially aligned with the bottom ends of the L-shaped terminal pins of the lower socket unit.

Hence, the double visual-interface socket according to the present invention uses the circuit board and the adapter module to connect signals at the terminal pins of the upper socket unit to a solder surface at a bottom portion of the double visual-interface socket, thereby minimizing the lengths of the terminal pins of the upper socket unit. By doing so, the characteristic impedance of the finished product will comply with related specifications so as to ensure the transmission quality of high-frequency video signals.

BRIEF DESCRIPTION OF THE SEVERAL VIEWS OF THE DRAWINGS

The invention as well as a preferred mode of use, further objectives, and advantages thereof will be best understood by referring to the following detailed description of an illustrative embodiment in conjunction with the accompanying drawings, wherein:

FIG. 2.1, FIG. 2.2 and FIG. 2.3 (hereinafter collectively referred to as FIG. 2) and FIG. 3.1, FIG. 3.2, FIG. 3.3. FIG. 3.4 and FIG. 3.5 (hereinafter collectively referred to as FIG. 3) are exploded perspective views of a double visual-interface socket according to an embodiment of the present invention when viewed from different angles;

DETAILED DESCRIPTION OF THE INVENTION

The present invention provides a double visual-interface socket including two socket units stacked up, wherein both socket units comply with the DVI standard. The features of the present invention are described herein by way of the DVI-I Dual-Link type sockets depicted in the accompanying drawings.

Figure 1:
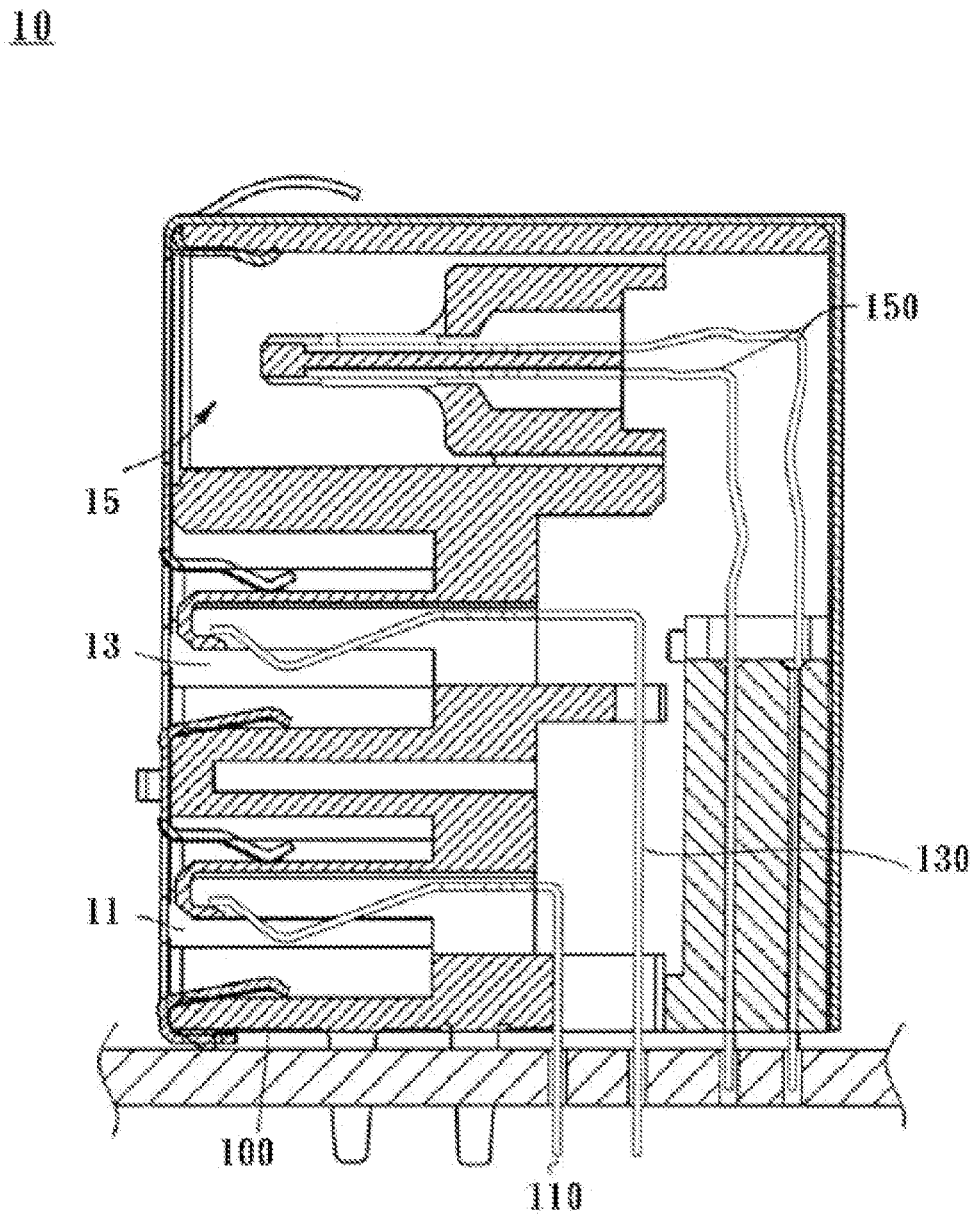
FIG. 1 (PRIOR ART)
FIG. 1 is a sectional view of a conventional stacked-type socket.
Figure 4:
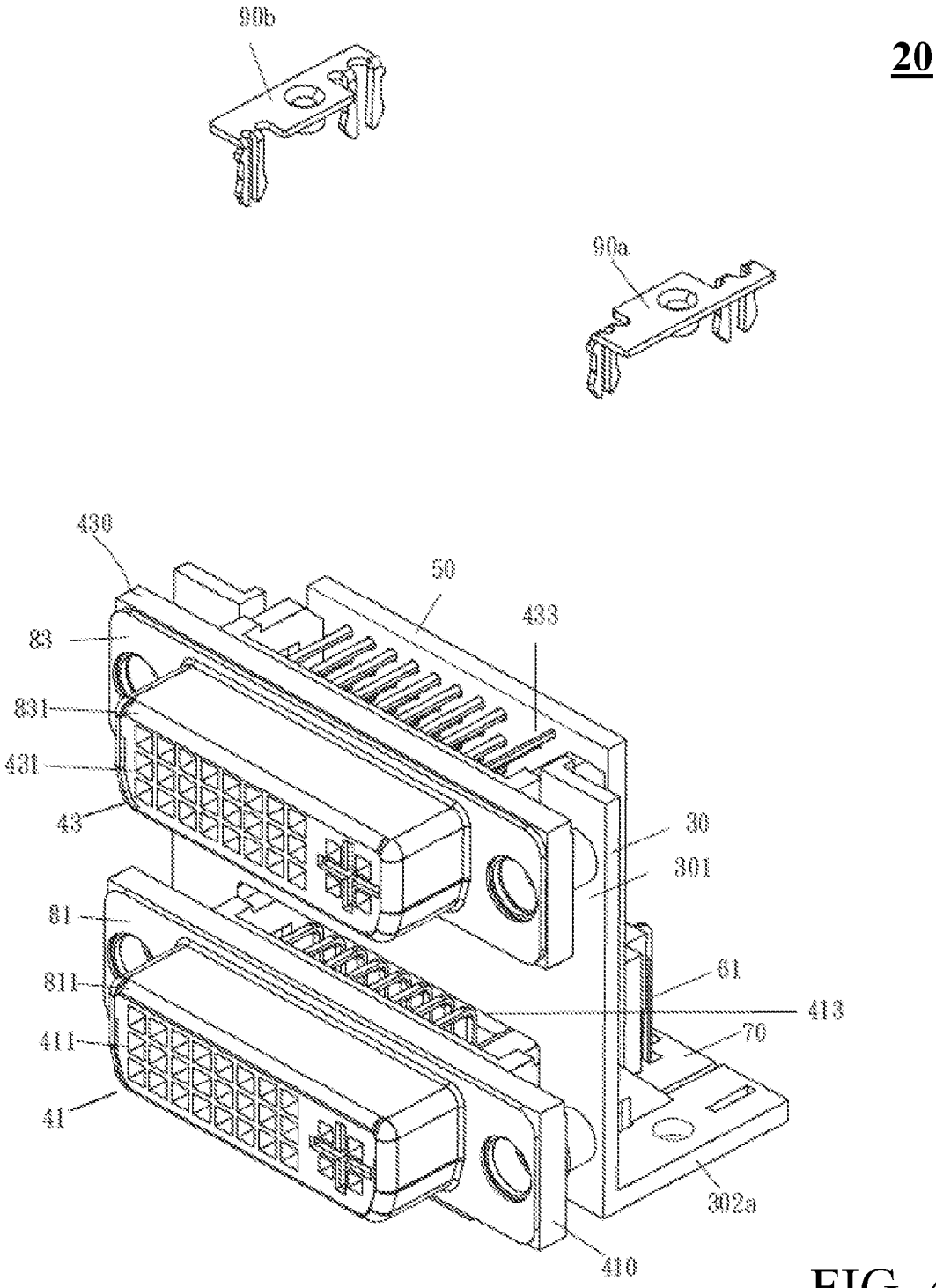
FIG. 4 and FIG. 5 are partially assembled views of the double visual-interface socket shown in FIGS. 2 and 3, when viewed from different angles.
Figure 5:
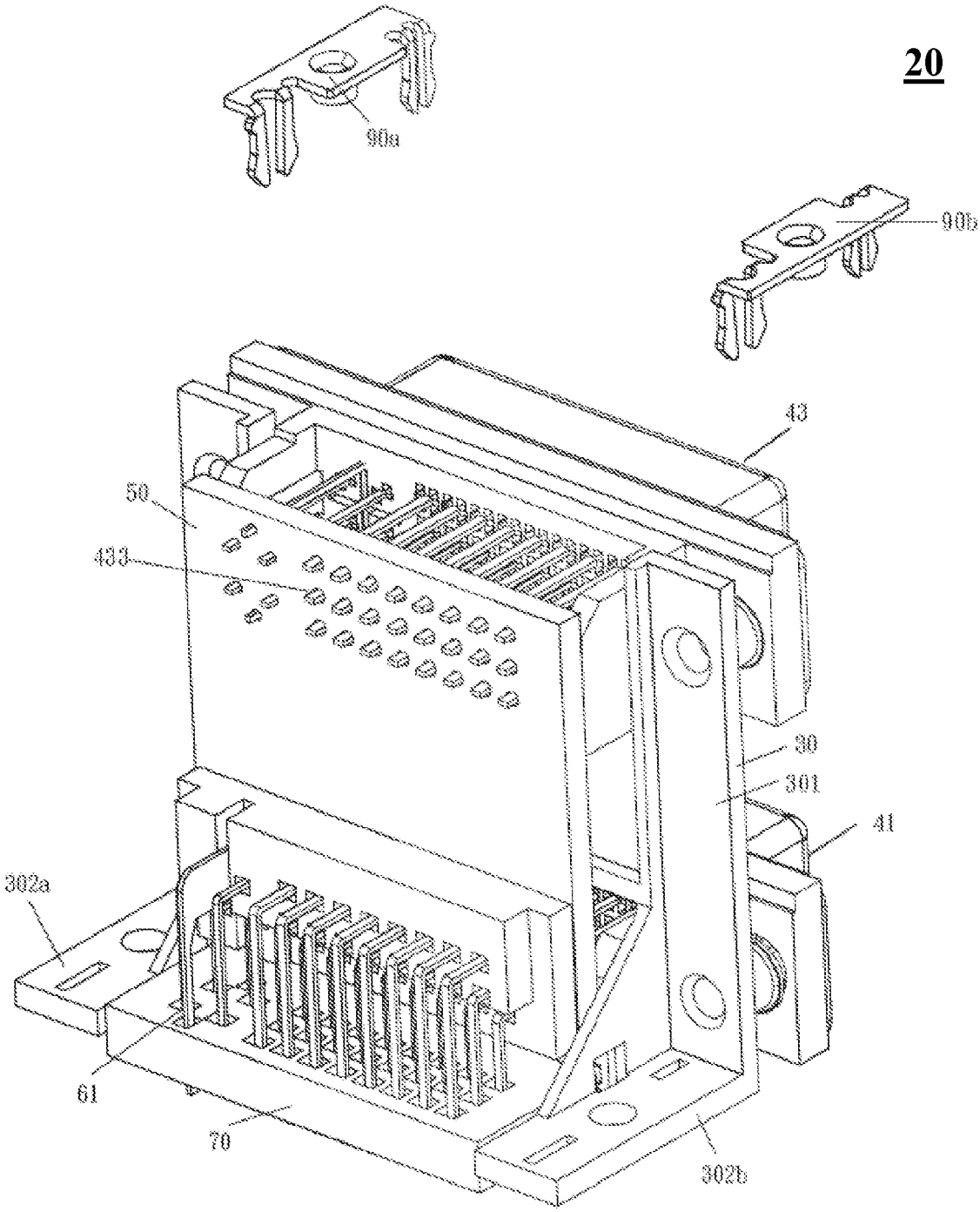
Figure 6:
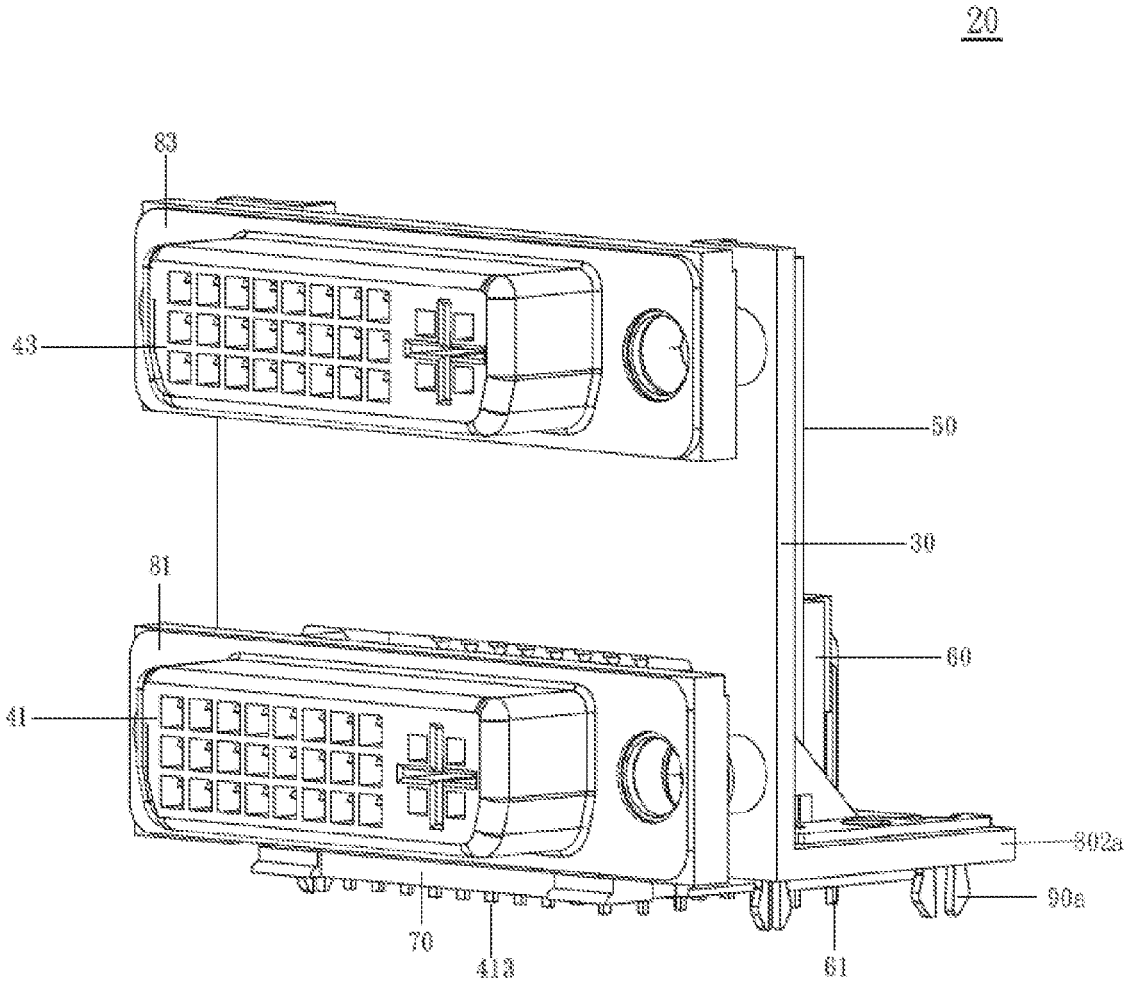
FIG. 6 is a perspective view of the double visual-interface socket shown in FIGS. 2 through 5.

Please refer to FIGS. 2 through 6 for an embodiment of the present invention. FIG. 2 and FIG. 3 are exploded perspective views of a double visual-interface socket according to the embodiment of the present invention when viewed from different angles. FIG. 4 and FIG. 5 are partially assembled views of the double visual-interface socket shown in FIGS. 2 and 3, when viewed from different angles. FIG. 6 is a perspective view of the double visual-interface socket according to the embodiment of the present invention.

As shown in the drawings, a double visual-interface socket 20 includes a frame 30, a lower socket unit 41, an upper socket unit 43, a circuit board 50, an adapter module 60, a lower metal housing 81, an upper metal housing 83, and two positioning elements 90*a*, 90*b*.

The frame 30 has a positioning wall 301 and two bottom plates 302*a*, 302*b*. The positioning wall 301 is coupled with and perpendicular to the bottom plates 302*a*, 302*b*. The positioning wall 301 is an H-shaped plate formed with two pairs of threaded positioning posts 31*a*, 31*b* and 33*a*, 33*b*. The plane where bottom surfaces of the bottom plates 302*a*, 302*b* lie is the predetermined solder surface of the double visual-interface socket 20.

The lower socket unit 41 has an insulating body 410 and includes a plurality of L-shaped terminal pins 413. The insulating body 410 is provided with an electrical connection portion 411 and two threaded holes 415*a*, 415*b*. Each of the terminal pins 413 has an arm extending into a corresponding one of electrical connection grooves formed in the electrical connection portion 411. Each of the terminal pins 413 further has an opposite arm whose bottom end faces the plane where the bottom plates 302*a*, 302*b* are located.

The lower metal housing 81 has a hollow metal housing body 810 formed with a sleeve 811 and two threaded holes 813*a*, 813*b*. The lower metal housing 81 is configured for enclosing an outer periphery of the lower socket unit 41 such that the sleeve 811 is mounted around the electrical connection portion 411. In addition, the threaded holes 813*a*, 415*a* correspond in position to the positioning post 31*a* while the threaded holes 813*b*, 415*b* correspond in position to the positioning post 31*b*. The double visual-interface socket 20 of the present embodiment further includes two set screws (not shown) for passing through the threaded holes 813*a*, 415*a* and the positioning post 31*a* and passing through the threaded holes 813*b*, 415*b* and the positioning post 31*b*, respectively, so as to secure the lower metal housing 81 and the lower socket unit 41 in position to the frame 30.

The upper socket unit 43 has an insulating body 430 and includes a plurality of terminal pins 433. The insulating body 430 is provided with an electrical connection portion 431 and two threaded holes 435*a*, 435*b*. Each of the terminal pins 433 has an end extending into a corresponding one of electrical connection grooves formed in the electrical connection portion 431 and an opposite end extending away from the electrical connection portion 431.

The upper metal housing 83 has a hollow metal housing body 830 formed with a sleeve 831 and two threaded holes 833*a*, 833*b*. The upper metal housing 83 is configured for enclosing an outer periphery of the upper socket unit 43 such that the sleeve 831 is mounted around the electrical connection portion 431. In addition, the threaded holes 833*a*, 435*a* correspond in position to the positioning post 33*a* while the threaded holes 833*b*, 435*b* correspond in position to the positioning post 33*b*. The double visual-interface socket 20 of the present embodiment further includes two set screws (not shown) for passing through the threaded holes 833*a*, 435*a* and the positioning post 33*a* and passing through the threaded holes 833*b*, 435*b* and the positioning post 33*b*, respectively, so as to secure the upper metal housing 83 and the upper socket unit 43 in position to the frame 30.

The adapter module 60 has an insulating body 63 and includes a plurality of L-shaped pins 61 arranged in rows. Each of the L-shaped pins 61 has an arm disposed in the insulating body 63 and an opposite arm whose bottom end faces the solder surface of the socket 20. The L-shaped pins 61 are arranged in accordance with the pin arrangement of DVI sockets.

The adapter module 60 is formed by forming insertion holes in the insulating body 63 such that the insertion holes correspond in position to the L-shaped pins 61, respectively. Then, the L-shaped pins 61 are inserted into the insertion holes and positioned therein.

Alternatively, the adapter module 60 is formed in such a way that the L-shaped pins 61 are coupled with and secured in position to the insulating body 63 during the manufacturing process of the insulating body 63. More particularly, the insulating body 63 is injection molded from a thermoplastic material. The injection mold is designed according to the contour and dimensions of the insulating body 63, and the L-shaped pins 61 are positioned in the mold before the thermoplastic material is injected into the mold. As a result, due to the thermoplasticity of the injected material, the insulating body 63 tightly covers the L-shaped pins 61 and securely positions the L-shaped pins 61 in a mechanical way.

The circuit board 50, which is disposed parallel and adjacent to the positioning wall 301, includes a plurality of conductive terminal guide holes 51 corresponding horizontally in position to the upper socket unit 83 and a plurality of conductive extension guide holes 53 corresponding horizontally in position to the lower socket unit 81. Each of the terminal guide holes 51 is electrically connected with a corresponding one of the extension guide holes 53. The circuit board 50 is provided with a plurality of transmission wires for connecting the electrically connected guided holes.

The terminal guide holes 51 correspond in position, size, and arrangement to the terminal pins 433, so as for the terminal pins 433 to be inserted respectively into the terminal guide holes 51 and be electrically connected therewith by soldering. The extension guide holes 53 correspond in position, size, and arrangement to the L-shaped pins 61, so as for the L-shaped pins 61 to be inserted respectively into the extension guide holes 53 and be electrically connected therewith by soldering. After the assembling and soldering processes, the bottom ends of the exposed arms of the L-shaped pins 61 are substantially aligned with the bottom ends of the terminal pins 413 of the lower socket unit 41. In other words, terminal signals of the upper socket unit 43 are connected via the circuit board 50 and the adapter module 60 to the solder surface at the bottom portion of the socket 20.

The double visual-interface socket 20 of the present invention further includes a base 70. The base 70 has an insulating body 700 provided with a plurality of lower pin through-holes 71 and a plurality of upper pin through-holes 73. The base 70 is installed between the bottom plates 302*a*, 302*b* of the frame 30. The lower pin through-holes 71 and the upper pin through-holes 73 correspond in size and arrangement to the terminal pins 413 and the L-shaped pins 61, respectively, so as to be inserted by and assist in positioning the terminal pins 413 and the L-shaped pins 61, respectively. After assembly, the bottom ends of the terminal pins 413 and the bottom ends of the L-shaped pins 61 pass through and extend out of a bottom surface of the insulating body 700.

Each of the positioning elements 90*a*, 90*b* includes two sets of resilient fasteners for being inserted into slots provided in a display card or motherboard so as to assist in positioning the double visual-interface socket 20 on the display card or motherboard. The positioning elements 90*a*, 90*b* are inserted respectively into specific engagement positions on the bottom plates 302*a*, 302*b* such that the resilient fasteners pass through and are exposed from the bottom surfaces the bottom plates 302*a*, 302*b*, respectively.

It is worth mentioning that, while the exposed arms of the L-shaped pins 61 in the present embodiment are located outward of, i.e., facing away from, the socket 20, the exposed arms of the L-shaped pins 61 may also be located in such a way as to face the socket 20 in a different embodiment. In the latter case, the location of the circuit board 50 and the lengths of the terminal pins 433 will need modification.

It should also be noted that the arrangement and dimensions of the pins of the double visual-interface socket 20, as well as the dimensions of the entire socket structure and the materials used for making the various components, comply with the specifications set forth in the DVI standard and therefore are not described at length herein.

In short, according to the above detailed description of the illustrative embodiment of the present invention, the disclosed double visual-interface socket 20 uses the circuit board 50 and the adapter module 60 to connect signals at the terminal pins 433 of the upper socket unit 43 to the solder surface at the bottom portion of the socket 20. Consequently, the characteristic impedance of the finished socket is brought into conformity with related specifications, thereby ensuring the transmission quality of high-frequency video signals.

What is claimed is:

1. A double visual-interface socket, compliant with socket design rules set forth in the Digital Visual Interface (DVI) standard, the double visual-interface socket comprising:

a frame, having a positioning wall and a bottom plate coupled perpendicularly with the positioning wall;

a lower socket unit, provided transversely at the positioning wall and comprising a plurality of terminal pins, each said terminal pin having a bottom end facing a plane where a bottom surface of the bottom plate is located;

an upper socket unit, provided transversely at the positioning wall and above the lower socket unit while comprising a plurality of terminal pins;

an adapter module, comprising a plurality of L-shaped pins arranged in rows, the L-shaped pins corresponding in arrangement to the terminal pins of the lower socket unit; and a circuit board, provided adjacent to the positioning wall and having:

a plurality of terminal guide holes, wherein the terminal pins of the upper socket unit are inserted respectively into the terminal guide holes so as to be electrically connected therewith by soldering; and a plurality of extension guide holes, each electrically connected with a corresponding said terminal guide hole, wherein the L-shaped pins of the adapter module have ends inserted respectively into the extension guide holes so as to be electrically connected therewith by soldering, and the L-shaped pins of the adapter module further have opposite ends substantially aligned with the bottom ends of the terminal pins of the lower socket unit.

2. The double visual-interface socket of claim 1, wherein the terminal guide holes and the extension guide holes of the circuit board correspond horizontally in position to the upper socket unit and the lower socket unit, respectively.

3. The double visual-interface socket of claim 1, further comprising a base assembled to the frame, wherein the base has an insulating body provided with a plurality of lower pin through-holes inserted respectively by the terminal pins of the lower socket unit and a plurality of upper pin through-holes inserted respectively by the L-shaped pins of the adapter module.

4. The double visual-interface socket of claim 1, wherein the adapter module further has an insulating body, and the L-shaped pins of the adapter module are provided in the insulating body.

5. The double visual-interface socket of claim 1, further comprising a positioning element, wherein the positioning element comprises a resilient fastener inserted into the bottom plate so as to pass through and be exposed from the bottom surface of the bottom plate.

6. The double visual-interface socket of claim 1, wherein the circuit board is provided with a plurality of transmission wires for connecting each said terminal guide hole with an electrically corresponding said extension guide hole.

7. The double visual-interface socket of claim 1, wherein each of the lower socket unit and the upper socket unit has an insulating body provided with a threaded hole.

8. The double visual-interface socket of claim 7, further comprising two set screws, wherein the positioning wall of the frame is provided with two positioning posts corresponding in position to the threaded holes of the lower socket unit and of the upper socket unit, respectively, so as for the two set screws to secure the lower socket unit and the upper socket unit in position to the positioning wall.

9. The double visual-interface socket of claim 8, further comprising a lower metal housing and an upper metal housing for enclosing a periphery of the lower socket unit and a periphery of the upper socket unit, respectively.

10. The double visual-interface socket of claim 9, wherein the lower metal housing is provided with a threaded hole corresponding in position to the threaded hole of the lower socket unit and a corresponding said positioning post of the positioning wall so as for a said set screw to secure the lower metal housing and the lower socket unit in position to the frame.

11. The double visual-interface socket of claim 9, wherein the upper metal housing is provided with a threaded hole corresponding in position to the threaded hole of the upper socket unit and a corresponding said positioning post of the positioning wall so as for a said set screw to secure the upper metal housing and the upper socket unit in position to the frame.

* * * * *